United States Patent [19]

Becher

[11] 4,344,829

[45] Aug. 17, 1982

[54] PROCESS FOR RECOVERY OF BENZENE AND CHLORINE FROM WASTE PRODUCTS

[75] Inventor: Heinz-Manfred Becher, Bingen, Fed. Rep. of Germany

[73] Assignee: Celamerck GmbH & Co. KG, Ingelheim, Fed. Rep. of Germany

[21] Appl. No.: 243,386

[22] Filed: Mar. 13, 1981

Related U.S. Application Data

[63] Continuation of Ser. No. 164,589, Jun. 30, 1980, abandoned.

[30] Foreign Application Priority Data

Jun. 29, 1979 [DE] Fed. Rep. of Germany ..... 2926329

[51] Int. Cl.[3] ..... C25B 1/26; C25C 1/16; C25C 3/04

[52] U.S. Cl. ..... 204/72; 204/118; 204/128; 204/131; 204/62

[58] Field of Search ..... 204/130–131, 204/118, 59 M, 66, 128, 72, 62, 78, 73 R

[56] References Cited

U.S. PATENT DOCUMENTS 4,162,948 7/1979 Yagii et al. ..... 204/72

*Primary Examiner*—R. L. Andrews

*Attorney, Agent, or Firm*—Hammond & Littell, Weissenberger & Muserlian

[57] ABSTRACT

An improved process for recovering benzene and chlorine from hexachlorocyclohexanes by reacting the waste isomers from the production of lindane with zinc and electrolysis of the zinc chloride obtained, characterized in that the reaction is effected in the cathode compartment of an electrolytic cell divided by a diaphragm, the zinc being produced in situ at the cathode.

4 Claims, 2 Drawing Figures

PROCESS FOR RECOVERY OF BENZENE AND CHLORINE FROM WASTE PRODUCTS

Figure 2:
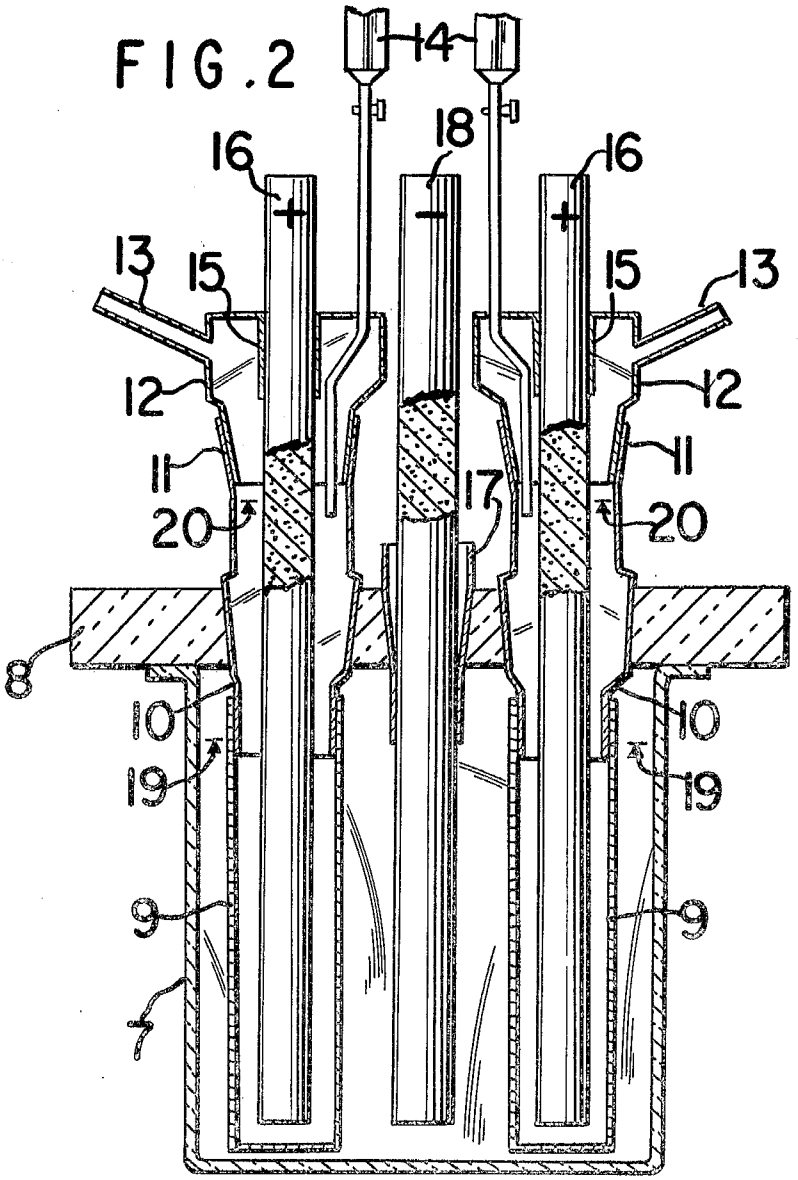

This is a continuation of copending application Ser. No. 164,589, filed June 30, 1980, now abandoned.

This invention relates to a novel process for the recovery of benzene and chlorine from waste products of the manufacture of the insecticide γ-hexachlorocyclohexane (HCH), also known as lindane.

BACKGROUND OF THE INVENTION

The waste products of the manufacture of lindane consist essentially of isomeric hexachlorocyclohexanes. They are obtained in significant amounts in addition to the desired γ-isomer. Recovery of the starting materials, benzene and chlorine, is therefore of great importance. It is known that the 1,2,3,4,5,6-hexachlorocyclohexane isomers (HCH isomers) can be reacted with zinc dust in aqueous suspension to form benzene and zinc chloride [Chem. Abstr. 46 (1952), 3962 e; 48 (1954), 2096 ab]. However, satisfactory degrees of reaction are obtained only if they are mixed thoroughly for a long time, since two solid phases have to react with each other and the resulting third phase (zinc chloride) has to be dissolved by the water in order to prevent a blockage of the reaction surfaces. Because of these complicated heterogenous reaction conditions, the reaction of larger quantities is, very expensive. The use of alcohols, for example methanol, for dissolving the organic substrate is likewise known [Chem. Abstr. 47 (1953), 5906 b; 46 (1952), 3962 e]; however, very large amounts of zinc are required, and the processing is more difficult.

It is also known to recover zinc from zinc chloride by electrolysis.

DESCRIPTION OF THE INVENTION

We have discussed that the known processes for obtaining benzene from hexachlorocyclohexane isomers and for obtaining chlorine from the zinc chloride produced can advantageously be combined with each other under suitable conditions.

The novel process pursuant to the present invention is characterized in that the reaction between the hexachlorocyclohexane isomers and zinc is effected in the cathode compartment of an electrolytic cell divided by a diaphragm, whereby the zinc is produced in situ eletrolytically at the cathode.

Situated in the cathode compartment is a heated mixture of aqueous zinc chloride solution containing 30 to 60%, preferably about 50%, by weight of zinc chloride and a solution of hexachlorocyclohexane isomers in an organic solvent which is inert under the reaction conditions and substantially insoluble in water.

In the process of the invention the reaction temperature is appropriately selected so that during the reaction only a little solid zinc is present at any given time. The process is therefore generally carried out at temperatures above 95° C.

The combined reactions can be represented as follows:

Reaction I:

$$C_6H_6Cl_6 + 3\ Zn \rightarrow C_6H_6 + 3\ ZnCl_2$$

Reaction II:

$$3\ ZnCl_2 \xrightarrow{\text{electrolysis}} 3\ Zn + 3\ Cl_2$$

Examples of suitable solvents are chlorobenzene, 1,2,4-trichlorobenzene, benzene, xylene, or also mixtures thereof.

The addition of small quantities of an emulsifier which is as stable as possible under the reaction conditions is beneficial.

The anolyte consists preferably of an aqueous zinc chloride solution, similar to the aqueous phase of the catholyte. Carbon (for example, as "synthetic carbon" or graphite) has proved to be favorable as the cathode material.

The anode consists of a material whose suitability for anodic chlorine release is known. The chlorine is released anodically in parallel with the reactions in the cathode compartment.

One advantage of the process of the present invention derived from the fact that the Cl-concentration in the anolyte can be kept relatively high during the entire duration of electrolysis. Undesirable anodic secondary reactions are thereby checked and corrosion of the anode remains minimal, even if it consists of carbon.

The diaphragm is intended to prevent contact of the organic phase of the catholyte and of the zinc with the anode and the chlorine gas formed thereon. A separation of the aqueous phase of the catholyte from the anolyte is not required. Suitable materials for the diaphragm are porous inorganic materials which are not eletrically conductive, such as porous ceramic, asbestos which is stable in a weakly acid medium, or fiberglass. Anion exchanger diaphragms with a sufficient stability under the reaction conditions can likewise be used.

The properties of the emulsifier are not critical. However, it is of advantage to use a sufficiently stable, nonionic emulsifier having a neutral reaction in order to prevent it from migrating in the electrical field, while ensuring minimal decomposition. Also, in order to minimize the transfer to the anode compartment due to diffusion and mixing, its solubility in water should be as low as possible. Moreover, it is very favorable if it is composed only of C, H and O atoms, since a decomposition and anodic disintegration of the emulsifier cannot be avoided completely when the aqueous electrolyte is circulated. The electrolyte would therefore gradually become contaminated with inorganic ions and the anode corrosion would be intensified if the emulsifier contained other atoms than those mentioned above such as S or N, β-HCH decomposes distinctly more slowly than the other HCH-isomers; it therefore remains largely undecomposed if the decomposition according to the present invention of the industrial HCH isomer mixture (about 10% by weight of β-HCH content) is stopped before the passage of the theoretical amount of current. If largely pure β-HCH is decomposed, there occurs as intermediate a somewhat larger quantity of zinc than during decomposition of other isomers.

The process of the invention can be effected batchwise or continuously in tank of plateframe cells. The shape of the electrodes and that of the diaphragms depends on the requirements of construction of the electrolytic cells.

The process is effected as described in the following Examples.

The following examples illustrate the present invention and will enable other skilled in the art to understand it more completely. It should be understood, however, that the invention is not limited solely to the particular examples given below.

EXAMPLES

A. Tank electrolytic cell

The reaction according to the present invention may be effected in the tank electrolytic cell hereinafter described with reference to the drawings. The cell housing is a glass pot heatable by an external oil bath with a ground lip at the upper edge on which a round glass cover lies tightly. The cover is equipped with several openings with standard ground sockets, into which the individual parts described below are inserted. The asymmetric arrangement of diaphragms, electrodes and agitator effects a thorough mixing of the catholyte.

Figure 1:
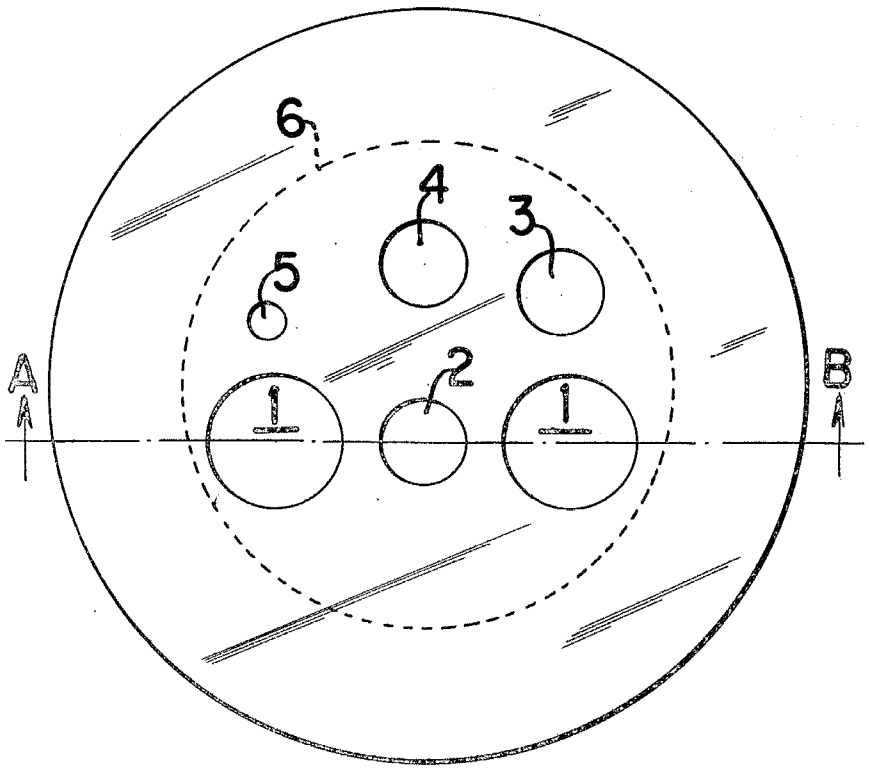

In the drawings, FIG. 1 shows the cover of the electrolytic cell in plan view. The openings 1 serve for inserting the diaphragm supports, and openings 2 for inserting the cathode support.

Opening 3 accomodates the reflux condenser with gas outlet tube opening 4, the agitator with seal, and finally opening 5 a thermometer. Moreover, the cathode compartment can be filled or emptied through opening 5. 6 is the inner perimeter of the glass pot.

FIG. 2 is a vertical section through the electrolytic cell along the line A-B in FIG. 1. The glass pot 7 forms with the cover 8 the cell housing. The porous clay cups 9 are inserted as diaphragms. These are cemented to the diaphragm support 10. The upper part of the diaphragm support is equipped with a ground portion 11, into which a corresponding ground spigot of the anode support 12 fits. The anode support is equipped with a gas outlet pipe 13, anolyte supply container 14 and a glass tube 15, into which the anode rod 16 consisting of carbon is tightly glued. The cathode support 17 consists of a glass tube, into which the cathode rod 18 is tightly glued. The cathode support 17 is connected to cover 8 by a ground joint. The marks 19 and 20 indicate the filling height in the cathode and anode compartments, respectively.

(B) Reactions

EXAMPLE 1

Decomposition of an industrial mixture of waste isomers from lindane production (industrial $\alpha$-HCH) of the following composition:

83–84% $\alpha$-1,2,3,4,5,6-hexachlorocyclohexane,
9–10% $\beta$-1,2,3,4,5,6-hexachlorocyclohexane,
1% $\gamma$-1,2,3,4,5,6-hexachlorocyclohexane,
1% $\epsilon$-1,2,3,4,5,6-hexachlorocyclohexane and
1.5% volatile impurities (mostly $H_3COH$), using chlorobenzene as the inert organic solvent and a small amount of a non-ionic emulsifier difficultly soluble in water and containing only C, H and O (cathode current density: 10 A/dm$^2$; electrochemically active area: 0.785 dm$^2$).

140 gm (~ 0.47 mol) of industrial $\alpha$-HCH of the above-mentioned composition and one drop of emulsifier of the carboxylate type were dissolved in 200 ml of chlorobenzene at 90° C. The portion remaining undissolved at this temperature ($\beta$-HCH and inorganic impurities) was filtrated at this temperature via a steam-heated double-wall glas frit suction filter and washed afterwards with 100 ml of chlorobenzene at 90° C. (6.0 gm of undissolved material remained). The filtrate (about 300 ml) was filled into the cathode compartment of the electrolytic cell which had been charged beforehand with 2.3 liters of an aqueous 50% by weight zinc chloride solution at 90° C., and the two anode compartments were filled with the same solution to the mark 20 indicated in FIG. 2 (about 140 ml of solution per anode compartment). After addition of the organic solution, the cathode compartment was filled with an amount of hot aqueous solution such that the filling level indicated by mark 19 in FIG. 2 is reached. From then on, the two-phase catholyte was stirred well, and heating was continued until a gentle reflux was observed (about 100° C. internal temperature). Then the electrolytic current was turned on and adjusted to 8.0 A (corresponding to 10 A/dm$^2$ cathode current density), whereby a voltage of 4.7 to 4.8 V developed between the electrodes and remained practically constant for the whole period of electrolysis. During electrolysis the speed of the agitator is adjusted so that the phases were mixed well, but only a little foam was formed.

The chlorine gas formed during electrolysis at the anodes was passed through a flask cooled to 0° C. to 5° C. Zinc chloride solution carried along was separated therein; moreover, a large part of the steam contained in the hot chlorine gas was condensed therein. Subsequently, the gas thus treated was condensed in a tarred cold trap cooled with dry ice/methanol (crude yield: 69 gm).

After the subsequent evaporation a little water remained (about 1 gm).

The yield of chlorine was determined more exactly by absorbing, instead of condensing, the resulting chlorine gas in excess aqueous potassium iodide solution (1 kg of potassium iodide in 1.5 liters of water). A small aliquot portion of iodine was thereafter titrated, and the result was converted (pure yield: 67.5 gm of chlorine).

During the electrolysis the anolyte quantity decreased, since some solution passed into the cathode compartment and the liberated chlorine gas entrained some liquid. This quantity was replaced during electrolysis in order to keep the filling level constant (about 30 ml per anode compartment).

During electrolysis metallic zinc formed at the cathode which reacted immediately with the HCH dissolved in the organic phase of the catholyte, so that only a small amount of the metal was ever present in the cathode compartment. Moreover, some hydrogen formed which was collected and measured (about 700 ml).

After the passage of 54.0 Ah (2.0 F.) of electric current, the electrolysis was stopped. After turning off the current, gentle refluxing was continued while stirring until no more solid particles were discernable; this was the case after a few minutes. The electrolyte was then cooled to 80° C., the reflux condenser was replaced by a descending condenser, and a mixture of organic phase and water was distilled off until the head temperature remained constant at 98° C., that is, all the benzene had passed over. This was the case when about 180 ml of organic phase were present in the distillate. The two phases of the distillate were separated. The benzene contained in the organic phase was determined by GC (22.5 gm) and isolated for the most part by fractional distillation in a column (19 gm).

After the organic phase and water had been distilled off from the cathode compartment, as described above, the residue was allowed to cool to 70° C. and was transferred to a separating funnel for separation of the two phases. The two anode compartments were likewise emptied. The two anolytes were combined and filtered. The filtrate, the aqueous phase of the catholyte and that of the abovementioned distillate were combined. The clear aqueous solution thus obtained was used for the next batch; volatile organic impurities (for example, methanol from the industrial HCH) were removed by distillation and losses, if any, were made up.

The organic phases separated in the separating funnel was evaporated to dryness in vacuo, leaving undecomposed HCH (39.0 gm). Instead, the organic phase can be used in the following batch (allowing for its HCH content).

EXAMPLE 2

Decomposition of the industrial α-HCH specified in Example 1, using a mixture of 90% by weight of 1,2,4-trichlorobenzene and 10% by weight of benzene as the inert organic solvent, and a small quantity of a non-ionic emulsifier difficultly soluble in water (cathode current density 10 A/dm$^2$).

The procedure was the same as in Example 1, but instead of chlorobenzene the same quantities by volume of a mixture of 90% by weight of 98% 1,2,4-trichlorobenzene and 10% by weight of benzene were used (a total of 368 gm of 98% 1,2,4-trichlorobenzene and 40 gm of benzene).

The separation of the benzene was simpler than when chlorobenzene was used as the inert solvent. The distillation out of the cathode compartment after the electrolysis was finished could be stopped after only 80 to 90 ml of organic phase had passed over.

| Summary of the results: | |
|---|---|
| Voltage between the electrodes (at a cathode current density of 10 A/dm$^2$) | 4.8 to 4.9 V |
| Quantity of electricity for electrolysis: | 54.0 Ah (2.0 F)<br>about 255 Wh |
| Hydrogen obtained: | about 700 ml (0.03 mol)<br>about 3% of the amount of electrolytic current |
| Crude yield of chlorine (condensed in cold trap): | 69 gm ($H_2O$ content 1.5%) |
| Pure chlorine yield (determined by titration of the released iodine): | 67.5 gm (0.95 mol)<br>95% of theory based on the amount of electrolytic current supplied |
| Yield of benzene (calculated from the amount of the organic phase of the distillate and its GC analysis, taking into account the amount of benzene added before electrolysis): | 22 gm (0.28 mol)<br>84% of theory based on the amount of electrolytic current supplied |
| Reacted HCH (calculated from the used and unreacted amounts): | 93 gm (0.32 mol)<br>96% of theory based on the amount of electrolytic current supplied. |

EXAMPLE 3

Decomposition of the industrial α-HCH specified in Example 1, using a mixture of 90% by weight of distilled industrial trichlorobenzene isomer mixture containing about 75% of 1,2,4-isomer, and 10% by weight of benzene as the inert organic solvent, and a small amount of a non-ionic emulsifier difficultly soluble in water.

The procedure was the same as in Example 2, but instead of 98% 1,2,4-trichlorobenzene, a distilled trichlorobenzene isomer mixture with a content of about 75% of 1,2,4-isomer was used. The results were the same as in Example 2.

EXAMPLE 4

Decomposition of the industrial α-HCH specified in Example 1 under the conditions of Example 2 with the modification that the electrolytic current is adjusted to 12 A (corresponding to 15 A/dm$^2$ of cathode current density).

The procedure was the same as in Example 2, except that the electrolytic current was adjusted to 12 A (corresponding to 15 A/dm$^2$ of cathode current density). At this current strength a voltage of 5.9 to 6.0 V developed between the electrodes. The remaining results were the same as those in Example 2.

EXAMPLE 5

Decomposition of largely pure β-HCH, using chlorobenzene as the inert organic solvent and a non-ionic emulsifier difficultly soluble in water (cathode current density: about 8.8 A/dm$^2$).

The procedure was the same as in Example 1, but with the following modifications:

89 gm (0.3 mol) of β-HCH (instead of 140 gm [0.47 mol] of HCH-isomer mixture) were used.

The hot turbid mixture of β-HCH and chlorobenzene was introduced without previous filtration into the cathode compartment of the electrolytic cell which was charged beforehand with the hot 50% aqueous zinc chloride solution.

10 Drops of emulsifier were added thereto. The electrolytic current was adjusted to 7A. After the passage of 35 A h (1.3 F) the electrolysis was stopped. The catholyte was refluxed thereafter for two hours while vigorously stirring.

| Summary of the results: | |
|---|---|
| Voltage between the electrodes (at a cathode current density of 8.75 A/dm$^2$): | about 4,5 V |
| Amount of electricity for electrolysis: | 35 A h (1.3 F)<br>~ 158 Wh |
| Hydrogen obtained: | 500 ml (0.02 mol)<br>about 3% of the amount of electrolytic current) |
| Zinc metal still present after the reaction was finished: | 1.2 gm (0.018 mol)<br>about 3% of the amount of electrolytic current |
| Pure chlorine yield (determined by titration of the released iodine): | 44.1 gm (0.62 ml)<br>95% of theory based on the quantity of electrolytic current supplied. |
| Yield of benzene: | Not determined |
| Reacted β-HCH (calculated from the amounts used and recovered): | 59.8 gm (0.206 mol),<br>95% of theory based on the amount of electrolytic current supplied. |

While the present invention has been illustrated with the aid of certain specific embodiments thereof, it will be readily apparent to others skilled in the art that the invention is not limited to these particular embodiments, and that various changes and modifications may be made without departing from the spirit of the invention or the scope of the appended claims.

I claim:

1. In the method of recovering benzene and chlorine from a mixture of isomeric hexachlorocyclohexanes obtained as a waste product in the manufacture of lindane, which comprises reacting said mixture with zinc and subjecting the resulting zinc chloride to electrolysis, the improvement which resides in that the reaction is performed with a solution of said mixture of isomeric hexachlorocyclohexanes in a substantially water-immiscible organic solvent which is stable under the reaction conditions in the cathode compartment of a diaphragm electrolysis cell, and the zinc is produced at the cathode of said cell.

2. The method of claim 1, where the zinc chloride content of the catholyte of said electrolysis cell is between 30 and 60% by weight.

3. The method of claim 1, where the zinc chloride content of the catholyte of said electrolysis cell is about 50% by weight.

4. The method of claim 1, where the reaction temperature is above about 95° C.

* * * * *